US009008320B2

(12) United States Patent
Sakagami

(10) Patent No.: US 9,008,320 B2
(45) Date of Patent: Apr. 14, 2015

(54) APPARATUS, SYSTEM, AND METHOD OF IMAGE PROCESSING, AND RECORDING MEDIUM STORING IMAGE PROCESSING CONTROL PROGRAM

(75) Inventor: Koubun Sakagami, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 434 days.

(21) Appl. No.: 13/334,762

(22) Filed: Dec. 22, 2011

(65) Prior Publication Data

US 2012/0163610 A1 Jun. 28, 2012

(30) Foreign Application Priority Data

Dec. 22, 2010 (JP) ..... 2010-286555
Nov. 24, 2011 (JP) ..... 2011-256026

(51) Int. Cl.

*H04R 29/00* (2006.01)
*H04R 3/00* (2006.01)
*H04S 7/00* (2006.01)
*H04R 1/40* (2006.01)

(52) U.S. Cl.

CPC ..... *H04R 3/005* (2013.01); *H04R 1/406* (2013.01); *H04S 7/30* (2013.01); *H04S 2400/11* (2013.01); *H04S 2400/15* (2013.01)

(58) Field of Classification Search

CPC ..... H04N 5/225; H04N 5/91; H04N 101/00; H04R 1/40; H04R 3/00; H04R 29/008; H04R 2201/34

USPC ..... 381/56, 333, 306, 388, 61, 26, 92, 122, 381/104–109, 110, 28, 119, 120; 348/14.08–14.09, 14.1; 352/8, 11, 352/12–19, 22, 23

See application file for complete search history.

(56) References Cited

U.S. PATENT DOCUMENTS

2007/0160240 A1* 7/2007 Ito et al. ..... 381/300
2008/0165992 A1* 7/2008 Kondo et al. ..... 381/182

FOREIGN PATENT DOCUMENTS

JP 60-116294 6/1985
JP 4-309087 10/1992
JP 2006261900 A * 9/2006
JP 2009-140307 6/2009

OTHER PUBLICATIONS

Seiko Rou, et al., "Special issue for devices supporting digital cameras and peripheral technologies", Face image processing technology for a digital camera, No. 210, Jul. 2009, 21 pages (with English Translation).

* cited by examiner

*Primary Examiner* — Leshui Zhang
(74) *Attorney, Agent, or Firm* — Oblon, McClelland, Maier & Neustadt, L.L.P.

(57) ABSTRACT

An image processing apparatus receives sound signals that are respectively output by a plurality of microphones, and detects a sound arrival direction from which sounds of the sound signals are traveled. The image processing apparatus calculates a sound level of sounds output from the sound arrival direction, and causes an image that reflects the sound level of sounds output from the sound arrival direction to be displayed in vicinity of an image of a user who is outputting the sounds from the sound arrival direction.

4 Claims, 7 Drawing Sheets

APPARATUS, SYSTEM, AND METHOD OF IMAGE PROCESSING, AND RECORDING MEDIUM STORING IMAGE PROCESSING CONTROL PROGRAM

CROSS-REFERENCE TO RELATED APPLICATIONS

This patent application is based on and claims priority pursuant to 35 U.S.C. §119 to Japanese Patent Application Nos. 2010-286555, filed on Dec. 22, 2010, and 2011-256026, filed on Nov. 24, 2011, in the Japan Patent Office, the entire disclosure of which is hereby incorporated herein by reference.

FIELD OF THE INVENTION

The present invention generally relates to an apparatus, system, and method of image processing and a recording medium storing an image processing control program, and more specifically to an apparatus, system, and method of displaying an image that reflects a level of sounds such as a level of voices of a user who is currently speaking and a recording medium storing a control program that causes a processor to generate an image signal of such image reflecting the level of sounds.

BACKGROUND

Japanese Patent Application Publication No. S60-116294 describes a television conference system, which displays an image indicating a level of sounds picked up by a microphone that is provided for each of meeting attendants. With the display of the level of sounds output by each attendant, the attendants are able to know who is currently speaking or the level of voices of each attendant. This system, however, has drawbacks such that a number of microphones has to be matched with a number of attendants to indicate the sound level for each attendant. Since the number of attendants will be different for each meeting, it has been cumbersome to prepare every microphone for each attendant.

SUMMARY

In view of the above, one aspect of the present invention is to provide a technique of displaying an image that reflects a level of sounds output by a user who is currently speaking, based on sound data output by a microphone array that collects sounds including the sounds output by the user, irrespective of whether a microphone is provided for each user. This technique includes providing an image processing apparatus, which detects a direction from which sounds of the sound data are traveled from the sound data output by the microphone array, and specifies a user who is currently speaking based on the detection result.

BRIEF DESCRIPTION OF THE DRAWINGS

A more complete appreciation of the disclosure and many of the attendant advantages and features thereof can be readily obtained and understood from the following detailed description with reference to the accompanying drawings, wherein.

The accompanying drawings are intended to depict example embodiments of the present invention and should not be interpreted to limit the scope thereof. The accompanying drawings are not to be considered as drawn to scale unless explicitly noted.

DETAILED DESCRIPTION OF EXAMPLE EMBODIMENTS

The terminology used herein is for the purpose of describing particular embodiments only and is not intended to be limiting of the present invention. As used herein, the singular forms "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

Figure 1:
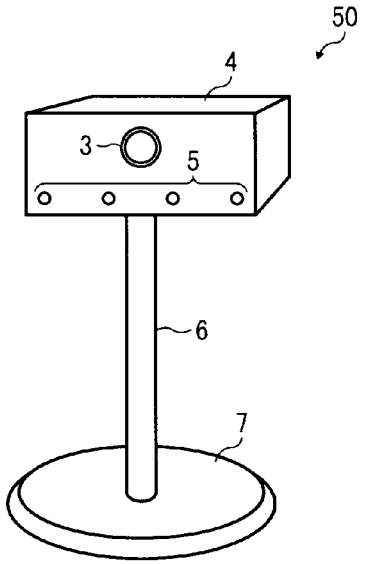
FIG. 1 is a schematic block diagram illustrating an outer appearance of an image processing apparatus, according to an example embodiment of the present invention.

FIG. 1 illustrates an outer appearance of an image processing apparatus 50, according to an example embodiment of the present invention. The image processing apparatus 50 includes a body 4, a support 6 that supports the body 4, and a base 7 to which the 6 is to be fixed. In this example, the support 6 has a columnar shape, and may be adjusted to have various heights. The body 4 has a front surface, which is provided with an opening from which a part of an image capturing device 3 is exposed, and openings through which sounds are collected to be processed by a plurality of microphones 5. The body 4 can be freely removed from the support 6.

The image capturing device 3 may be implemented by a video camera capable of capturing an image as a moving image or a still image. The microphones 5 ("microphone array 5") may be implemented by an array of microphones 5*a* to 5*d* as described below referring to FIG. 2. The number of microphones 5 is not limited to four, as long as it is more than one.

In this example, as described below referring to FIGS. 12 and 13, the image processing apparatus 50 is provided in a conference room where one or more users (meeting attendants) are having videoconference with one or more users (meeting attendants) at a remotely located site. In such case, the image capturing device 3 captures an image of users, and sends the captured image to the other site. The microphone array 5 collects sounds output by the users to generate sound data, and sends the sound data to the other site. As image data and sound data are exchanged between the sites, videoconference is carried out between the sites.

Figure 2:
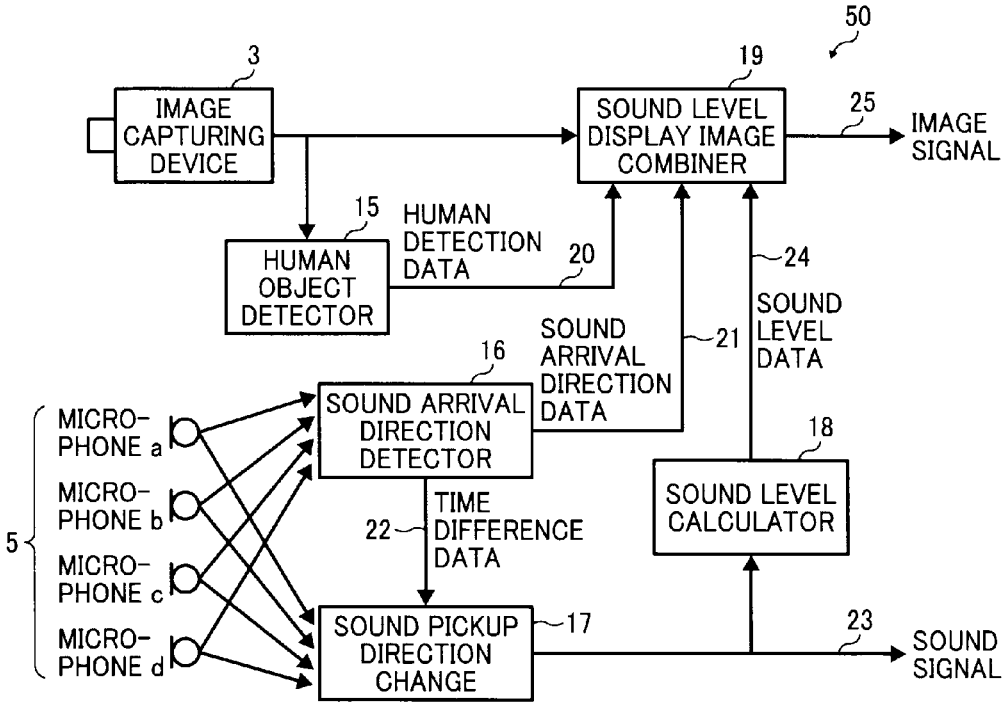
FIG. 2 is a schematic block diagram illustrating a functional structure of the image processing apparatus of FIG. 1.

FIG. 2 is a schematic block diagram illustrating a functional structure of the image processing apparatus 50 of FIG. 1. The image processing apparatus 50 further includes a human object detector 15, a sound arrival direction detector 16, a sound pickup direction change 17, a sound level calculator 18, and a sound level display image combiner 19. These units shown in FIG. 2 correspond to a plurality of functions or functional modules, which are executed by a processor according to an image processing control program that is loaded from a nonvolatile memory onto a volatile memory. More specifically, in addition to the microphone array 5 and the image capturing device 3, the image processing apparatus 50 includes the processor such as a central processing unit (CPU), and a memory including the nonvolatile memory such as a read only memory (ROM) and the volatile memory such as a random access memory (RAM). Upon execution of the image processing control program, the processor causes the image processing apparatus 50 to have the functional structure of FIG. 2.

Further, the image processing control program may be written in any desired recording medium that is readable by a general-purpose computer in any format that is installable or executable by the general-purpose computer. Once the image processing control program is written onto the recording medium, the recording medium may be distributed. Alternatively, the image processing control program may be downloaded from a storage device on a network, through the network.

In addition to the processor and the memory, the image processing apparatus 50 is provided with a network interface, which allows transmission or reception of data to or from a network. Further, the image processing apparatus 50 is provided with a user interface, which allows the image processing apparatus 50 to interact with the user.

The image capturing device 3 captures an image of users, such as attendants who are having videoconference, and sends the captured image to the human object detector 15. In this example, the image processing apparatus 50 is placed such that the image containing all uses are captured by the image capturing device 3. The image capturing device 3 sends the captured image to the human object detector 15 and to the sound level display image combiner 19.

The human object detector 15 receives the captured image from the image capturing device 3, and applies various processing to the captured image to detect a position of an image of a human object that corresponds to each of the users in the captured image. The detected position of the human object in the captured image is output to the sound level display image combiner 19 as human detection data 20.

The microphone array 5 picks up sounds output by one or more users using the microphones 5*a* to 5*d*, and outputs sound signals generated by the microphones 5*a* to 5*d* to the sound arrival direction detector 16.

The sound arrival direction detector 16 receives sound data, i.e., the sound signals respectively output from the microphones 5*a* to 5*d* of the microphone array 5. The sound arrival direction detector 16 detects the direction from which the sounds of the sound signals are output, using the time differences in receiving the respective sound signals from the microphones 5*a* to 5*d* to output such information as sound arrival direction data 21. The direction from which the sounds are output, or the sound arrival direction, is a direction viewed from the front surface of the body 4 on which the microphone array 5 and the image capturing device 3 are provided. Since the microphones 5*a*, 5*b*, 5*c*, and 5*d* are disposed at positions different from one another, the sounds that are respectively traveled to the microphones 5*a*, 5*b*, 5*c*, and 5*d* may be arrived at the microphones 5 at different times, depending on the direction from which the sounds are traveled. Based on this time differences, the sound arrival direction detector 16 detects the sound arrival direction from which the sounds are traveled, and outputs such information as the sound arrival direction data 21 to the sound level display image combiner 19. The sound arrival direction detector 16 further outputs time difference data 22, which indicates the time differences in receiving the sound signals that are respectively output from the microphones 5*a* to 5*d*.

The sound pickup direction change 17 is input with the sound signals output by the microphone array 5, and the time difference data 22 output by the sound arrival direction detector 16. The sound pickup direction change 17 changes the direction from which the sounds are picked, based on the time difference data 22 received from the sound arrival direction detector 16. As described below referring to FIG. 5, for each of the sound signals, the sound pickup direction change 17 changes the direction from which the sounds are picked up through the microphone array 5, to output the sound signal reflecting the sounds output by a user who is currently speaking while canceling out other sounds received from the other direction. The sound signal is output to the sound level calculator 18, and to the outside of the image processing apparatus 50 as the sound signal 23.

The sound level calculator 18 receives the sound signal 23, which is generated based on the sounds output by the microphone array 5, from the sound pickup direction change 17. The sound level calculator 18 calculates a sound level of sounds indicated by the sound signal 23 output from the sound pickup direction change 17, and outputs the calculation result as sound level data 24 to the sound level display image combiner 19. More specifically, as described below, the sound level calculator 18 calculates effective values of the sound signal in a predetermined time interval, and outputs the effective values as the sound level data 24.

For example, assuming that the sound signal having a sampling frequency of 8 kHz is input, the sound level calculator 18 obtains effective values of the sound signal for a time interval of 128 samples of sound data, by calculating a square root of a total sum of the squared values of the sample. Based on the effective values of the sound signal, the sound level data 24 is output. In this example, the time interval of 128 samples is 16 msec=1/8000 minutes*128 samples.

Figure 8:
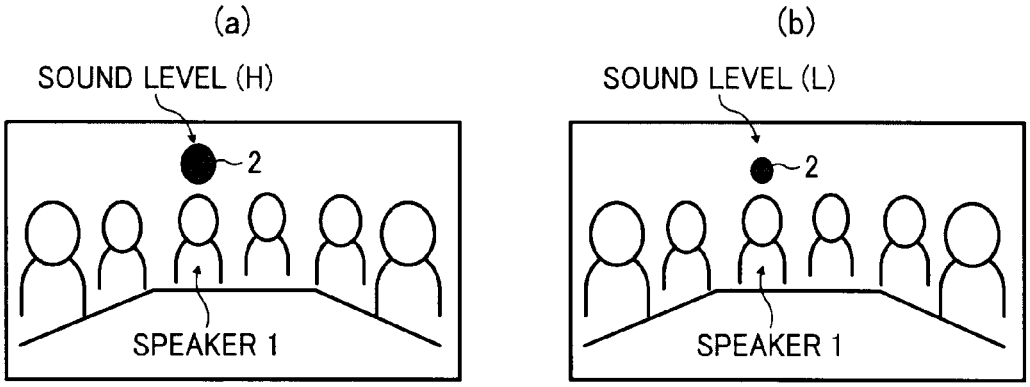
FIG. 8 is an example illustration of an image that reflects a level of sounds output by a user who is currently speaking, which is expressed in the size of a circle displayed above an image of the user.

The sound level display image combiner 19 obtains the human detection data 20 output by the human object detector 15, the sound arrival direction data 21 output by the sound arrival direction detector 16, and the sound level data 24 output by the sound level calculator 18. Based on the obtained data, the sound level display image combiner 19 generates an image signal 25, which causes an image that reflects a sound level of sounds output by a user who is currently speaking to be displayed near the image of the user in the captured image captured by the image capturing device 3. For example, as illustrated in FIG. 8, the image that reflects the sound level of sounds output by a speaker 1 is displayed near the image of the speaker 1, in the form of circle having a size that corresponds to the detected sound level.

Based on the human detection data 20 indicating the position of the human object in the captured image for each of the users, and the sound arrival direction data 21 indicating a sound arrival direction of sounds of the detected sound signals, the sound level display image combiner 19 detects a user ("speaker") who is currently speaking, or outputting sounds, among the users in the captured image. The sound level display image combiner 19 further obtains the sound level of sounds output by the speaker, based on the sound level data 24. Based on the sound level of the sounds output by the speaker, the sound level display image combiner 19 generates an image that reflects the sound level of the sounds output by the speaker ("sound level image") in any graphical form or numerical form. Using the human detection data indicating the position of the image of the speaker, the sound level display image combiner 19 combines the sound level image with the captured image such that the sound level image is placed near the image of the speaker. The combined image is output to the outside of the image processing apparatus 50 as the image signal 25.

Figure 3:
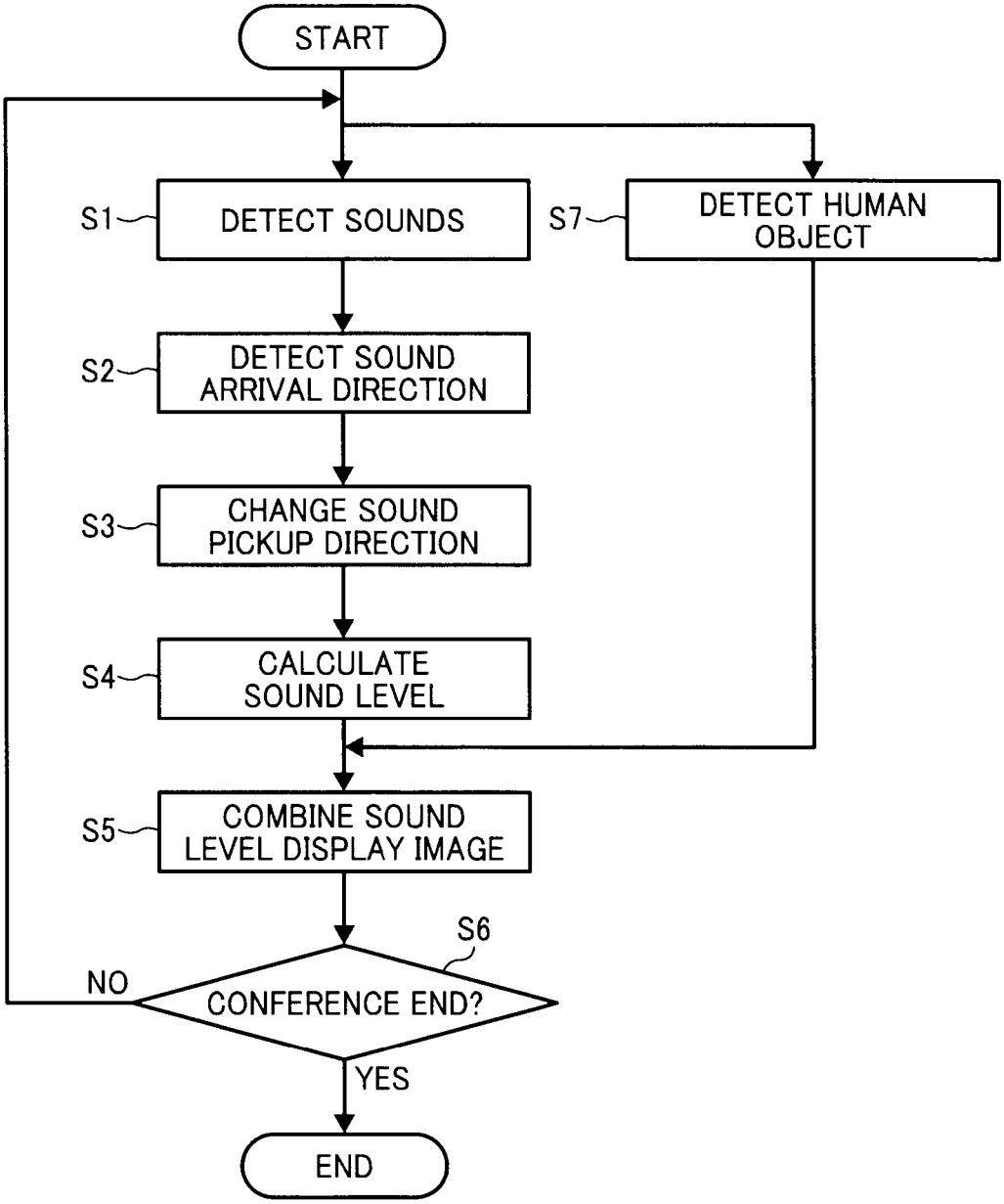
FIG. 3 is a flowchart illustrating operation of generating an image that reflects a sound level of sounds output by a user who is currently speaking, performed by the image processing apparatus of FIG. 1.

FIG. 3 is a flowchart illustrating operation of generating an image that reflects the sound level of sounds output by a speaker, and combining such image with a captured image, performed by the image processing apparatus 50, according to an example embodiment of the present invention. The operation of FIG. 3 is performed by the processor of the image processing apparatus 50, when a user instruction for starting operation is received. In this example, it is assumed that the user instruction for starting the operation of FIG. 3 is received, when the user starts videoconference.

At S1, the image processing apparatus 50 detects that sounds, such as human voices, are output, when the sound signals are output by the microphone array 5. More specifically, the image processing apparatus 50 determines that the sounds are detected, when the sound level of the sound signal output by the microphone array 5 continues to have a value that is equal to or greater than a threshold at least for a predetermined time period. By controlling the time interval, the sounds output by the user for a short time period, such as nodding, are ignored. This prevents an image from being constantly updated every time any user outputs any sound including nodding. When the sounds are detected, the operation proceeds to S2.

At S7, the image processing apparatus 50 detects an image of a human object in the captured image received from the image capturing device 3. More specifically, the image capturing device 3 outputs an image signal, that is a captured image including images (or human objects) of the users, to the human object detector 15. The human object detector 15 detects, for each of the users, a position of a human object indicating each user in the captured image, and outputs information regarding the detected position as the human detection data 20. S1 and S7 are performed concurrently.

At S2, the image processing apparatus 50 detects, for the sound signals received from the microphone array 5, the direction from which the detected sounds are traveled, using the sound arrival direction detector 16. The sound arrival direction detector 16 outputs the sound arrival direction data 21, and the time difference data 22 for each of the sound signals received from the microphone array 5.

At S3, the image processing apparatus 50 determines whether the sound arrival direction detected at S2 is different from the sound pickup direction from which the sounds are picked up, using the time difference data 22. When they are different, the image processing apparatus 50 changes the sound pickup direction from which the sounds are picked up, using the sound pickup direction change 17. The image processing apparatus 50 further obtains the sounds of the sound signals that reflect the sounds that are arrived from the detected sound arrival direction, and outputs the obtained sounds as the sound signal 23.

At S4, the sound level calculator 18 calculates the sound level of the sounds of the sound signal 23, as the sound level of sounds output by a speaker.

At S5, the sound level display image combiner 19 generates an image that reflects the sound level of the sounds output by the speaker, based on the human detection data 20, the sound output direction data 21, and the sound level data 24. The sound level display image combiner 19 further combines the image that reflects the sound level of the sounds output by the speaker, with the captured image data.

At S6, the image processing apparatus 50 determines whether to continue the above-described steps, for example, based on determination whether the videoconference is finished. The image processing apparatus 50 may determine whether the videoconference is finished, based on whether a control signal indicating the end of the conference is received from another apparatus such as a videoconference apparatus (FIG. 13), or whether a user instruction for turning off the power of the image processing apparatus 50 is received through a power switch of the image processing apparatus 50. More specifically, when it is determined that videoconference is finished ("YES" at S6), the operation ends. When it is determined that videoconference is not finished ("NO" at S6), the operation returns to S1 to repeat the above-described steps.

Figure 4A:
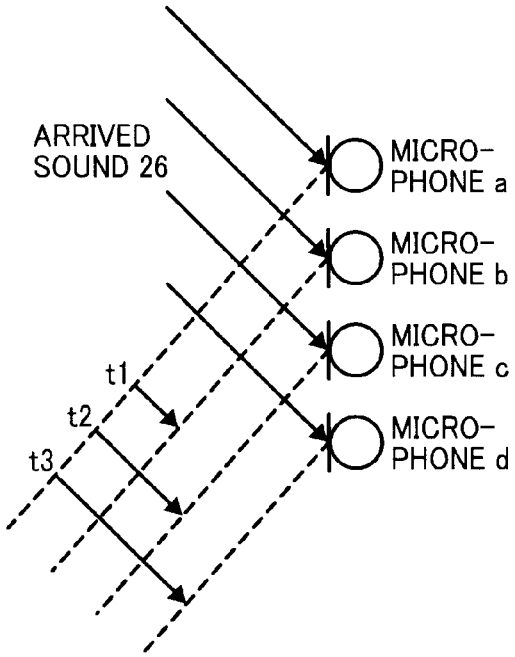
FIGS. 4A and 4B are an illustration for explaining operation of obtaining sound arrival direction data and time difference data from sound data, performed by a sound arrival direction detector of the image processing apparatus of FIG. 2, according to an example embodiment of the present invention.
Figure 4B:
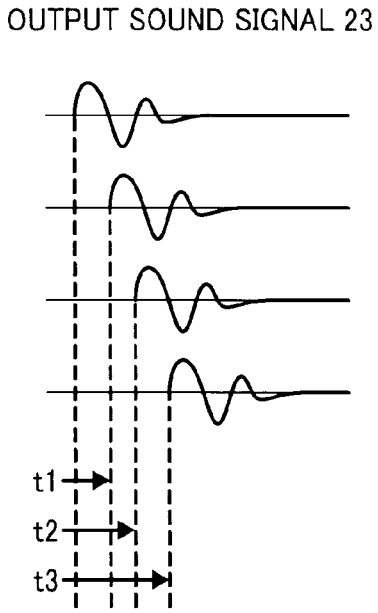

Referring now to FIGS. 4A and 4B, operation of obtaining sound arrival direction data and time difference data from sound signals output by the microphone array 5, performed by the sound arrival direction detector 16 of FIG. 2, is explained according to an example embodiment of the present invention.

If a user who is speaking sits in front of the microphone array 5 while facing the front surface of the body 4, the sounds output by the user are respectively input to the microphones 5*a* to 5*d* at substantially the same times. In such case, the output sound signals are output at substantially the same time from the microphones 5*a* to 5*d* such that the sound arrival direction detector 16 outputs the time difference data having 0 or nearly 0.

Referring to FIG. 4A, if the sounds 26 from the user are traveled to the microphones 5*a* to 5*d* in the direction that is diagonal with respect to the line that perpendicularly intersects the front surface of the microphone 5, the sounds 26 reach the microphones 5*a* to 5*d* at different times. Accordingly, the sound signals are output by the microphones 5*a* to 5*d* at different times such that the sound arrival direction detector 16 receives the sound signals at different times. In this example case, as illustrated in FIG. 4B, the sound arrival direction detector 16 receives the sound signal output from the microphone 5*a*, the sound signal output from the microphone 5*b*, the sound signal output from the microphone 5*c*, and the sound signal output from the microphone 5*d*, in this order. Based on the times at which the sound signals are received, the sound arrival direction detector 16 obtains the time differences t1, t2, and t3 with respect to the time when the sound signal is received from the microphone 5*a*, respectively, for the time at which the sound signal is received from the microphone 5*b* ("t1"), the time at which the sound signal is received from the microphone 5*c* ("t2"), and the time at which the sound signal is received from the microphone 5*d* ("t3"). Based on the obtained time differences t1, t2, and t3, the direction from which the sounds 26 are traveled can be detected. The direction from which the sounds 26 are traveled is a direction viewed from the front surface of the body 4 of the image processing apparatus 50. The sound arrival direction detector 16 outputs the time differences t1, t2, and t3 as the time difference data 22, and the direction from which the sounds 26 are output as the sound arrival direction data 21.

In FIG. 4, it is assumed that the sounds arrived at the microphones 5*a* to 5*b* are all come from an upper left side of the microphone array 5, however, the sound arrival direction may differ among the microphones depending on a location of each user who is currently speaking, if more than one user is speaking at the same time. However, in most cases, it is assumed that the sound arrival direction matches among the microphones that are disposed at different positions as there is only one user speaking at a time during videoconference.

Figure 5A:
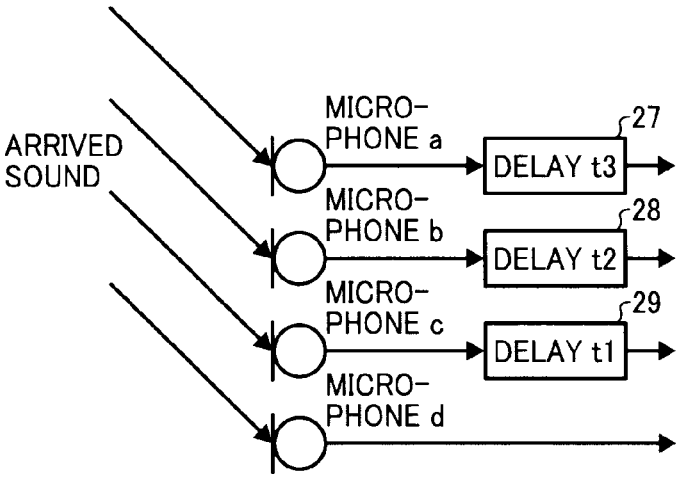
FIGS. 5A and 5B are an illustration for explaining a structure and operation of changing the pickup direction of sound data, performed by a sound pickup direction change of the image processing apparatus of FIG. 2, according to an example embodiment of the present invention.
Figure 5B:
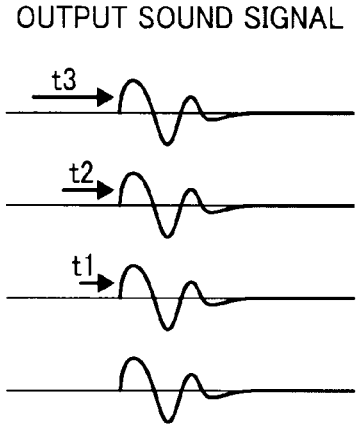

Referring now to FIGS. 5A and 5B, operation of changing the direction from which the sounds are picked up according to the detected sound arrival direction, and obtaining the sounds from the sound pickup direction, performed by the sound input direction change 17 of FIG. 2, is explained according to an example embodiment of the present invention.

The sound pickup direction change 17 adds the values of the time differences t1, t2, and t3, respectively, to the values of the times at which the sound signals are output by the microphone array 5. With this addition of the time difference, or a delay in receiving the sounds, the time differences that are observed among the sound signals received at different microphones 5 are canceled out. For example, as illustrated in FIG. 5A, the sound pickup direction change 17 includes a delay circuit 27 provided downstream the microphone 5*a*, a delay circuit 28 provided downstream the microphone 5*b*, and a delay circuit 29 provided downstream the microphone 5*c*. The delay circuit 27 adds the time difference t3 to the time at which the sound signal output by the microphone 5*a* such that the sound signal of the microphone 5*a* is output at the same time as the sound signal of the microphone 5*d* is output. The delay circuit 28 adds the time difference t2 to the sound signal output by the microphone 5*b* such that the sound signal is output at the same time as the sound signal of the microphone 5*d* is output. The delay circuit 29 adds the time difference t1 to the sound signal output by the microphone 5*c* such that the sound signal is output at the same time as the sound signal of the microphone 5*d* is output. Accordingly, as illustrated in FIG. 5B, the sound signals of the microphones 5*a* to 5*d* are output at substantially the same time. With addition of these sound signals, the sounds in the sound signals that are arrived from the detected sound arrival direction are emphasized, while canceling out the other sounds that are arrived from the other directions. Thus, the sound signal output by the sound pickup direction change 17 reflects the sounds output by the user who is currently speaking, which are collected from the detected sound arrival direction. In alternative to providing the delay circuits, the above-described operation of adding the value of the time difference data to the sound signal may be performed by the processor according to the image processing control program.

Figure 6:
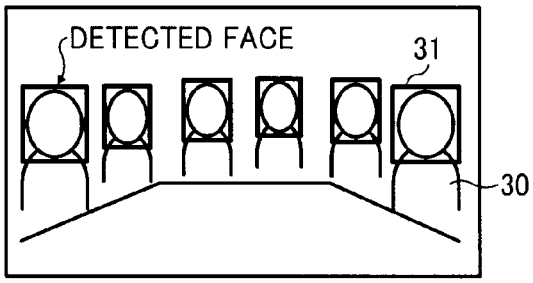
FIG. 6 is an illustration for explaining operation of detecting a face of each user in a captured image, performed by a human object detector of the image processing apparatus of FIG. 2, according to an example embodiment of the present invention.

In this example, a human object may be detected in the captured image in various ways. For example, as illustrated in FIG. 6, a face of a user may be detected in the captured image. The face of the user may be detected using any desired known method, for example, using the method of face detection described in Seikoh ROH, Face Image Processing Technology for Digital Camera, Omron, KEC Information, No. 210, July, 2009, pp. 16-22. In applying this technique to this example, performing whether the detected face has been registered is not necessary.

In this example case illustrated in FIG. 6, when the human object detector 15 detects a face of a user 30, the human object detector 15 outlines the detected face with a rectangle 31, and outputs the coordinate values of the rectangle 31 as the human detection data indicating the position of the human object. Assuming that the user 30 is speaking, an image that reflects the sound level of sounds output by the user 30 is positioned above the rectangle 31 using the human detection data such that the image reflecting the sound level is shown above the face of the user 30. For example, once the position of the face of a speaker in the captured image is determined, the sound level display image combiner 19 displays an image reflecting the sound level of the sounds output by the speaker above the face of the speaker in the captured image, as illustrated in FIG. 8. Further, the image reflecting the sound level in FIG. 8 is expressed in a circle size.

In alternative to displaying the image reflecting the sound level in the form of the circle size that is placed above the face of the speaker as illustrated in FIG. 8, the image reflecting the sound level may be displayed differently, for example, in a different form at a different position. For example, the image reflecting the sound level may be displayed at a lower portion of the face of the speaker, or any portion of a body of the speaker. Alternatively, the image reflecting the sound level may be changed according to the position of the speaker in the captured image. Further, the image reflecting the sound level may be displayed in any form other than circle size.

Figure 7:
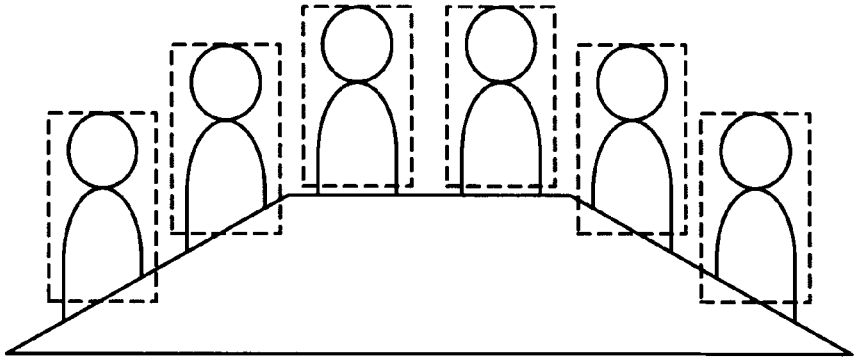
FIG. 7 is an illustration for explaining operation of detecting an upper body of each user in a captured image, performed by the human object detector of the image processing apparatus of FIG. 2, according to an example embodiment of the present invention.

In alternative to detecting a face, as illustrated in FIG. 7, an upper body of a user including a face of the user may be detected in the captured image. The upper body of the user may be detected using any desired known method, for example, the human detection method disclosed in Japanese Patent Application Publication No. 2009-140307.

FIG. 8 illustrates an example case in which an image that reflects a sound level of sounds output by a speaker is displayed in circle size that is placed above the speaker in the captured image.

More specifically, in this example, the sound level display image combiner 19 generates an image reflecting the sound level ("sound level image"), and combines the sound level image with the captured image obtained by the image capturing device 3 to output the combined image in the form of image signal 25.

Referring to FIG. 8, the sound level image, which is displayed as a circle 2 having a size that corresponds to the sound level of sounds output by a speaker 1, is displayed above the image of the speaker 1 in realtime. FIG. 8(*a*) illustrates an example case in which the sound level of the sounds output by the speaker 1 is relatively high, and FIG. 8(*b*) illustrates an example case in which the sound level of the sounds output by the speaker 1 is relatively low. With this display of the sound level image 2, any user who sees the captured image is able to recognize who is currently speaking, or the size of voices of the speaker 1.

The speaker, who is speaking to the users at the other site, may feel uncomfortable as the speaker himself or herself hardly recognizes whether the speaker is speaking loudly enough so that the users at the other site can hear. For this reasons, the speaker may tend to speak too loud. On the other hand, even if the speaker at one site is speaking too softly, the users at the other site may feel reluctant to request the speaker to speak louder. If the speaker is able to instantly see whether the sound level of one's voices is too loud or too soft, the speaker feels more comfortable in speaking to the users at the other site. For example, if the speaker realizes that the speaker is speaking too softly, the speaker will try to speak with louder voices such that videoconference will be carried out more smoothly.

In this example, the size of the circle 2 that is placed above the speaker 1 is changed in realtime, according to the sound level of the sounds output by the speaker 1. For example, when the sound level of the sounds becomes higher, the circle size is increased as illustrated in FIG. 8(*a*). When the sound level of the sounds becomes lower, the circle size is decreased as illustrated in FIG. 8(*b*). Since the sound level image is displayed in realtime, the users are able to recognize a speaker who is currently speaking, and the level of voices of the speaker.

The coordinate values (x, y) of the center of the position where the circle of the image reflecting the sound level is calculated as follows. In the following equations, X1 denotes the x coordinate value of the left corner of the human object image. Xr denotes the x coordinate value of the upper corner of the human object image. Yt denotes the y coordinate value of the upper corner of the human object image. Rmax denotes the maximum value of a radius of the circle that reflects the circle size when the maximum sound level is output. Yoffset denotes a distance between the human object image and the circle.

$$x=(X1+Xr)/2$$

$$y=Yt+R\max+Y\text{offset}$$

Further, the radius r of the circle is calculated as follows so that it corresponds to the sound level of the sounds, using a logarithmic scale. In the following equations, Rmax denotes the maximum value of a radius of the circle. p denotes a sound level, which is the power value in a short time period. Pmax denotes the maximum value of the sound level, which is the power value in a short time period with the maximum amplitude.

$$r=R\max*\log(p)/\log(P\max),\ \text{when } p>1$$

$$r=0,\ \text{when } p<=1$$

The short-time period power p of the signal X=(x1, x2, . . . , xN) is defined as follows.

$$P=\Sigma(N,i=1)(xi*xi)/N$$

For example, assuming that the sampling frequency is 16 kHz, and N=320, the short-time period power P is calculated using the samples of data for 20 ms. Further, in case of 16-bit PCM data having the amplitude that ranges between −32768 to 32767, the maximum level Pmax is calculated as 32767*32767/√2.

In the above-described example cases illustrated in FIG. 8, the sound level image is displayed at a section other than the human object image, for example, at a section above the human object image of the speaker. In such case, the captured image needs to have enough space in its upper section. If a face of the speaker is positioned at the upper section of the captured image such that there is not enough space for the sound level image to be displayed, the sound level image may be displayed at a different section such as below the face of the speaker, or right or left of the speaker. In such case, the coordinate values of the center of the circle of the sound level image are changed.

Figure 9:
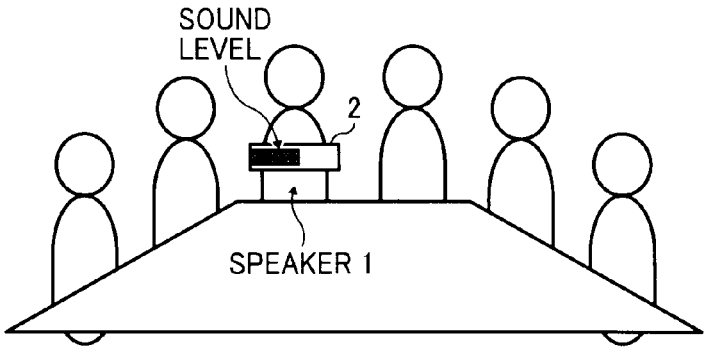
FIG. 9 is an example illustration of an image that reflects a level of sounds output by a user who is currently speaking, which is expressed in the length of a bar displayed at a center portion of an image of the upper body of the user.
Figure 10:
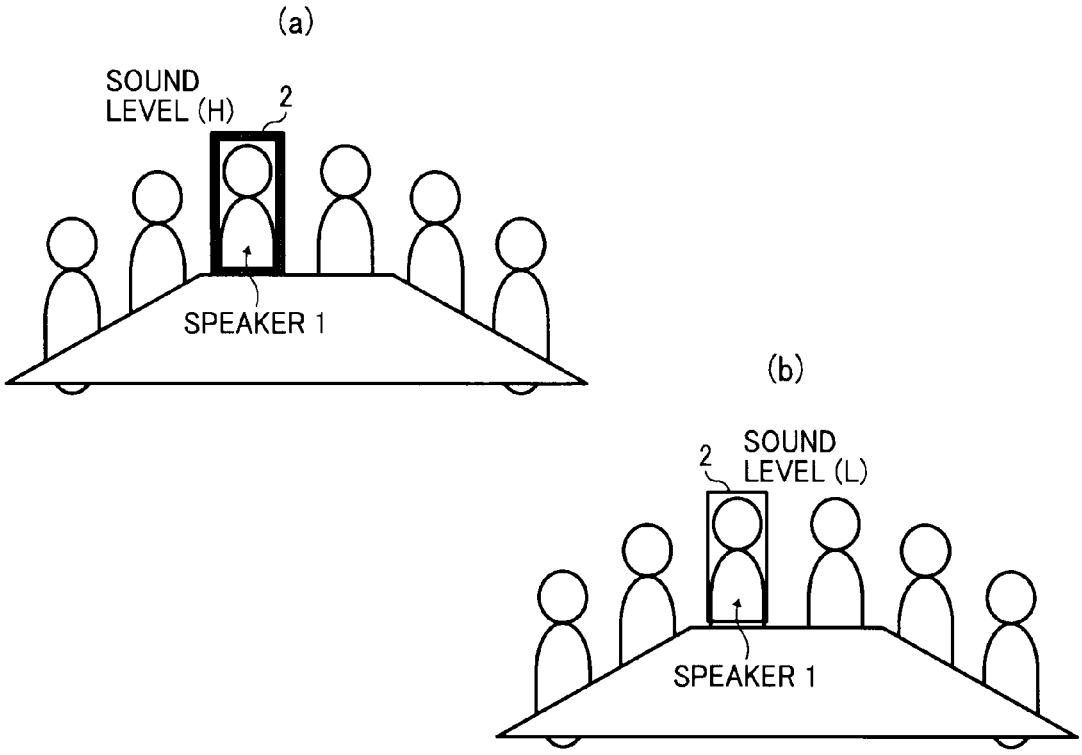
FIG. 10 is an example illustration of an image that reflects a level of sounds output by a user who is currently speaking, which is expressed in the thickness of a rectangular frame that outlines an image of the user.
Figure 11:
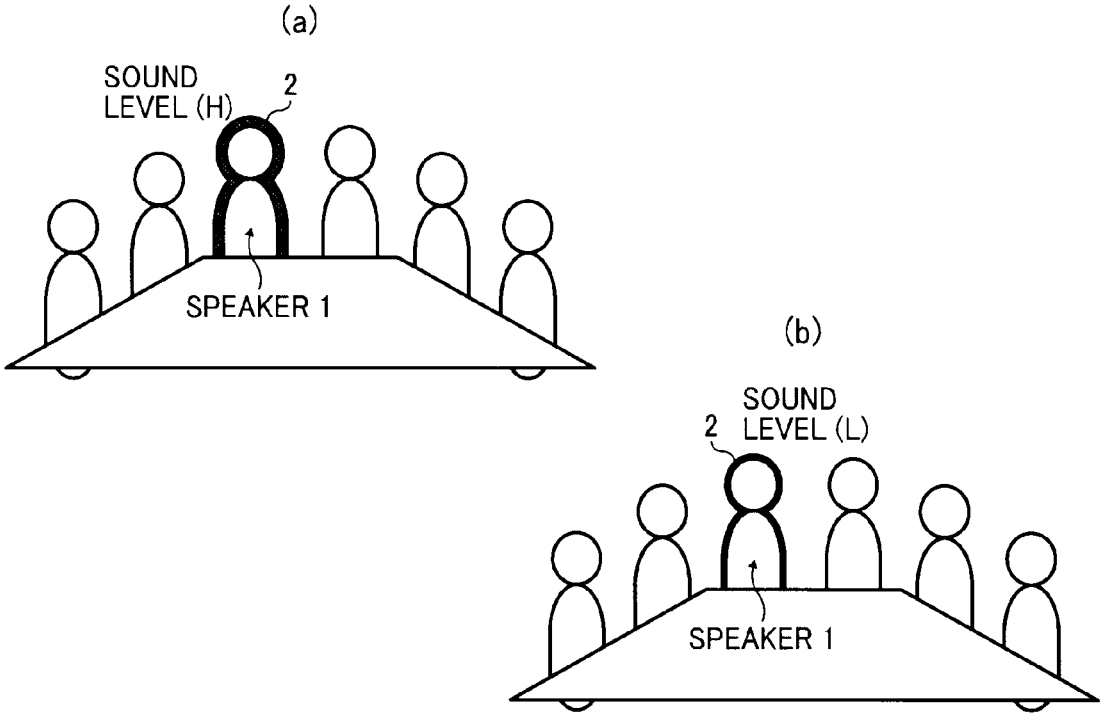
FIG. 11 is an example illustration of an image that reflects a level of sounds output by a user who is currently speaking, which is expressed in the thickness of outer line that outlines an image of the user.

Referring now to FIGS. 9 to 11, other examples of displaying a sound level image are explained. FIG. 9 illustrates an example case in which a sound level of sounds output by a speaker 1 is displayed in length of a bar graph 2 that is placed in a central portion of the upper body of the speaker 1.

FIG. 10 illustrates an example case in which a sound level of sounds output by a speaker 1 is displayed in thickness of a rectangular frame 2 that is placed around an image of the speaker 1. FIG. 10(*a*) illustrates an example case in which the sound level of sounds output by the speaker 1 is relatively high such that the thickness of the rectangular frame 2 increases. FIG. 10(*b*) illustrates an example case in which the sound level of sounds output by the speaker 1 is relatively low such that the thickness of the rectangular frame 2 decreases.

FIG. 11 illustrates an example case in which a sound level of sounds output by a speaker 1 is displayed in thickness of an outer line 2 that outlines an image of the speaker 1. FIG. 11(*a*) illustrates an example case in which the sound level of sounds output by the speaker 1 is relatively high such that the thickness of the outer line 2 increases. FIG. 11(*b*) illustrates an example case in which the sound level of sounds output by the speaker 1 is relatively low such that the thickness of the outer line 2 decreases.

In any of these cases illustrated in FIGS. 9 to 11, displaying the sound level image allows the users to instantly know a speaker who is currently speaking and the volume of voices output by the speaker. Further, since the sound level image is displayed on or right near the image of the speaker, a space in the captured image that is sufficient for displaying the sound level image is easily obtained.

Figure 12:
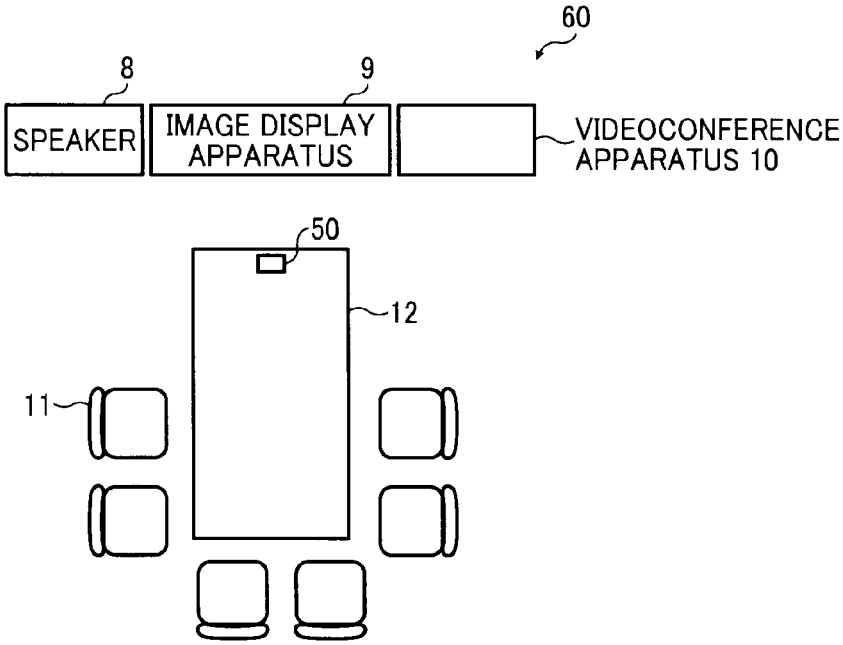
FIG. 12 is a schematic block diagram illustrating a configuration of an image processing system including the image processing apparatus of FIG. 1, according to an example embodiment of the present invention.
Figure 13:
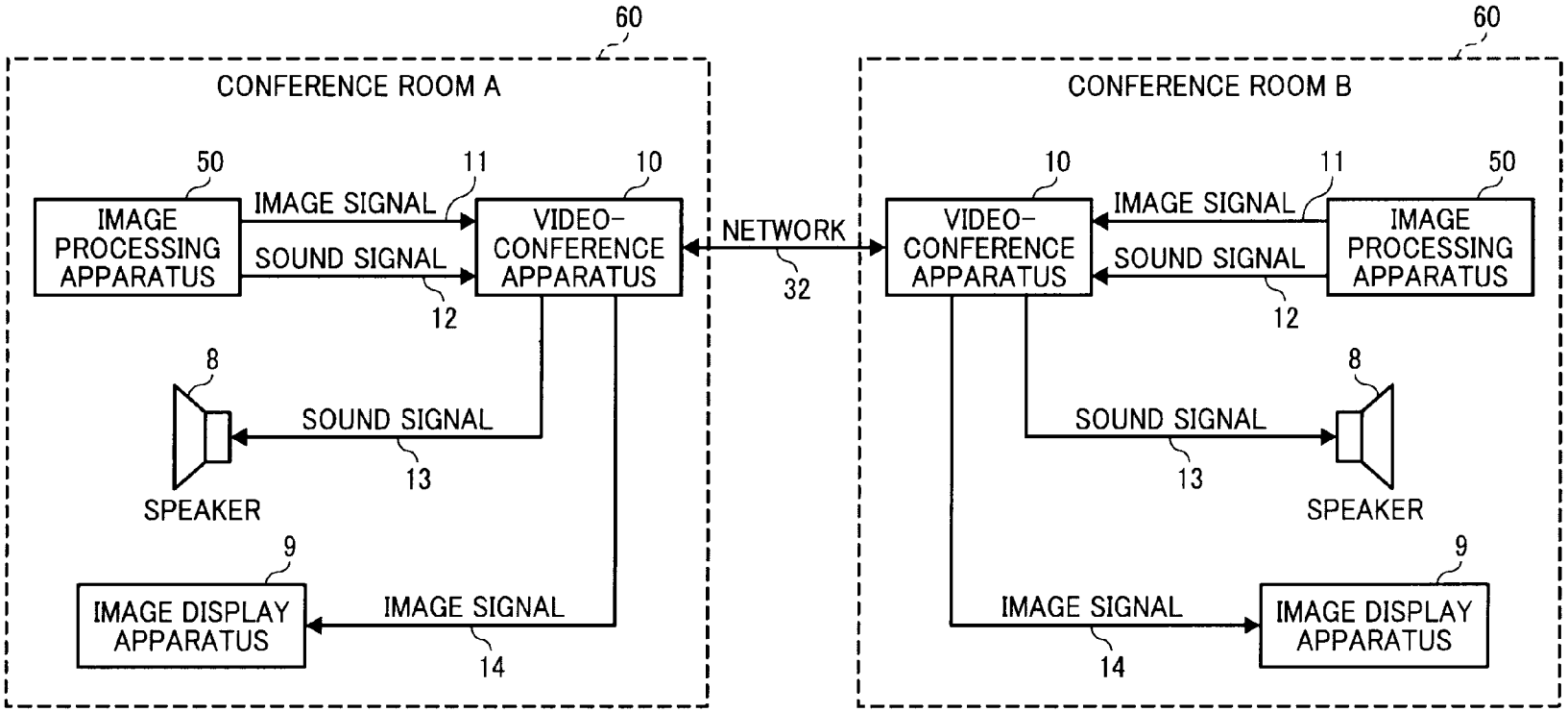
FIG. 13 is a schematic block diagram illustrating a structure of the image processing system of FIG. 12, when the image processing systems are each provided in the conference rooms that are remotely located with each other.

Referring now to FIGS. 12 and 13, a configuration of an image processing system is explained according to an example embodiment of the present invention.

FIG. 12 illustrates an example case in which an image processing system 60, which functions as a videoconference system, is provided in a conference room. The image processing system 60 includes the image processing apparatus 50 of FIGS. 1 and 2, an image display apparatus 9 that displays an image, a speaker 8 that outputs sounds such as voices of users, and a videoconference apparatus 10.

Assuming that the conference room is provided with a table 12 and a plurality of chairs 11, the image processing apparatus 50 may be placed on the top of the table 12. In such case, it is assumed that only the body 4 of the apparatus 50 is used. The image processing apparatus 50, which is provided with the image capturing device 3, captures an image of users on the chairs 11. Further, the image processing apparatus 50 picks up sounds output from the users, using the microphone array 5. Based on the captured image and the sounds, the image processing apparatus 50 generates an image signal 25, which includes a sound level image reflecting the sound level of sounds output by a user who is currently speaking. The image processing apparatus 50 outputs the image signal 25 and a sound signal 23 to the videoconference apparatus 10.

The videoconference apparatus 10 receives the image signal 25 and the sound signal 23 from the image processing apparatus 50, and transmits these signals as an image signal 11 and a sound signal 12 to an image processing apparatus 10 that is provided at a remotely located site through a network 32 (FIG. 13). Further, the videoconference apparatus 10 outputs an image signal 14 and a sound signal 13, which are received from the remotely located site through the network (FIG. 13), respectively, to the image display apparatus 9 and the speaker 8.

The image display apparatus 9 may be implemented by a monitor such as a television monitor, or a projector that projects an image onto a screen or a part of the wall of the conference room. The image display apparatus 9 receives the image signal 14 from the videoconference apparatus 10, and displays an image based on the image signal 14. The speaker 8 receives the sound signal 13 from the videoconference apparatus 10, and outputs sounds based on the sound signal 13.

In the example case illustrated in FIG. 13, it is assumed that videoconference takes place between users in the conference room A and users in the conference room B. The conference room A and the conference room B are remotely located with each other. In each of the conference rooms A and B, the image processing system 60 of FIG. 12 is provided. The image processing system 60 includes the image processing apparatus 50, the videoconference apparatus 10, the speaker 8, and the image display apparatus 9. The image processing system 60 in the conference room A and the image processing system 60 in the conference room B are communicable with each other through the network 32 such as the Internet or a local area network.

In operation, the image signal 25 and the sound signal 23 that are output from the image processing apparatus 50 in the conference room A are input to the videoconference apparatus 10. The videoconference apparatus 10 transmits the image signal 11 and the sound signal 12, which are respectively generated based on the image signal 15 and the sound signal 23, to the videoconference apparatus 10 in the conference room B through the network 32. The videoconference apparatus 10 in the conference room B outputs the image signal 14 based on the image signal 11 to cause the image display device 9 to display an image based on the image signal 14. The videoconference apparatus 10 in the conference room B further outputs the sound signal 13 based on the sound signal 12 to cause the speaker 8 to output sounds based on the sound signal 13. In addition to displaying the image of the conference room A based on the received image signal 14, the image display device 9 may display an image of the conference room B based on an image signal 11 indicating an image captured by the image processing apparatus 50 in the conference room B.

In describing example embodiments shown in the drawings, specific terminology is employed for the sake of clarity. However, the present disclosure is not intended to be limited to the specific terminology so selected and it is to be understood that each specific element includes all technical equivalents that operate in a similar manner.

Numerous additional modifications and variations are possible in light of the above teachings. It is therefore to be understood that within the scope of the appended claims, the disclosure of the present invention may be practiced otherwise than as specifically described herein.

With some embodiments of the present invention having thus been described, it will be obvious that the same may be varied in many ways. Such variations are not to be regarded as a departure from the spirit and scope of the present invention, and all such modifications are intended to be included within the scope of the present invention.

For example, elements and/or features of different illustrative embodiments may be combined with each other and/or substituted for each other within the scope of this disclosure and appended claims.

For example, the image capturing device 3 the image processing apparatus 50 may be an external apparatus that is not incorporated in the body 4 of the image processing apparatus 50.

Further, as described above, any one of the above-described and other methods of the present invention may be embodied in the form of a computer program stored in any kind of storage medium. Examples of storage mediums include, but are not limited to, flexible disk, hard disk, optical discs, magneto-optical discs, magnetic tapes, nonvolatile memory cards, ROM (read-only-memory), etc.

Alternatively, any one of the above-described and other methods of the present invention may be implemented by ASIC, prepared by interconnecting an appropriate network of conventional component circuits or by a combination thereof with one or more conventional general purpose microprocessors and/or signal processors programmed accordingly.

In one example, the present invention may reside in: an image processing apparatus provided with image capturing means for capturing an image of users to output a captured image and a plurality of microphones that collect sounds output by a user to output sound data. The image processing apparatus includes: human object detector means for detecting a position of a human object indicating each user in the captured image to output human detection data; sound arrival direction detector means for detecting a direction from which the sounds are traveled based on time difference data of the sound data obtained by the plurality of microphones; sound pickup direction change means for changing a direction from which the sounds are picked up by adding values of the time difference data to the sound data; sound level calculating means for calculating a sound level of sounds obtained by the sound pickup direction change means to output sound level data; and sound level display image combiner means for generating an image signal that causes an image that reflects a sound level of sounds output by the user to be displayed in the captured image, based on the human detection data output by the human detector means, the sound arrival direction data output by the sound arrival direction detector means, and the sound level data calculated by the sound level calculator means.

As described above, in order to detect a user who is currently speaking, the sound arrival direction from which the sounds output by the user are traveled is detected. Further, a human object indicating each user in a captured image is detected to obtain information indicating the position of the human object for each user. Using the detected sound arrival direction, the position of the user who is currently speaking is determined. Based on the sounds collected from the sound arrival direction, an image reflecting the sounds output by the user who is speaking is generated and displayed near the image of the user who is speaking in the captured image. In this manner, the microphone does not have to be provided for each of the users.

The sound level display image combiner means changes a size of the image that reflects the sound level according to the sound level of the user in realtime, based on information regarding the user that is specified by the human object detector and the sound arrival direction detector, and the sound level data.

For example, if the sound level image is to be displayed in circle size, the size of the circle increases as the sound level increases, and the size of the circle decreases as the sound level decreases.

The image processing apparatus detects the sounds when a sound level of the sounds continues to have a value that is equal to or greater than a threshold at least for a predetermined time period.

The present invention may reside in an image processing system including the above-described image processing apparatus, a speaker, and an image display apparatus.

The present invention may reside in a non-transitory recording medium storing a plurality of instructions which, when executed by a processor, cause a processor to perform an image processing method. The image processing method includes: receiving sound signals that are respectively output by a plurality of microphones; detecting a position of a human object that corresponds to each user in a captured image of users; obtaining, for each of the sound signals, a difference in time at which the sound signal is received from one of the microphones with respect to time at which the sound signal is received from the other one of the microphones to output time difference data for each sound signal; detecting a sound arrival direction from which sounds of the sound signals are traveled, based on the time difference data; changing a sound pickup direction from which the sounds of the sound signals are picked up to match the sound arrival direction by adding the time difference data to the sound signals, to obtain a sound signal of sounds output from the sound arrival direction; calculating a sound level of the sounds output from the sound arrival direction; and generating an image signal that causes display of a sound level image in the captured image, wherein the sound level image indicates the sound level of the sounds output from the sound arrival direction and is displayed in vicinity of the position of one of the detected human objects that is selected using the sound arrival direction.

What is claimed is:

1. An image processing apparatus, comprising:

an image capturing device to capture an image of users into a captured image;

a plurality of microphones that are disposed side by side; and a processor to:

receive sound signals that are respectively output by the plurality of the microphones, the sound signals representing a sound at the plurality of the microphones;

detect a sound source direction of a source of the received sound signals, based on time difference data, the time difference data indicating a difference in time at which the sound is received from one of the plurality of the microphones with respect to a time at which the sound is received from the other one of the plurality of the microphones;

calculate a sound level of the received sound signals of the sound output from the detected sound source direction;

detect, from among the users, a speaker who is generating the sound based on position information of the speaker and the detected sound source direction; and display a sound level image indicating the calculated sound level in a vicinity of an image of the speaker in the captured image by using the detected sound source direction and the calculated sound level, wherein a position of the sound level image with respect to the image of the speaker in the captured image is determined based on:

a x coordinate value of a left corner of the image of the speaker in the captured image;

x and y coordinate values of an upper corner of the image of the speaker in the captured image;

a size of the sound level image to be displayed in the captured image when the calculated sound level reaches a maximum sound level, and a distance between the image of the speaker and the sound level image in the captured image.

2. The image processing apparatus of claim 1, wherein the processor is further configured to:

change at least one of the position and the size of the sound level image in a realtime, wherein the position of the sound level image is changed according to the position information of the speaker and the detected sound source direction; and the size of the sound level image is changed according to the calculated sound level of the sound signals of the sound output from the detected sound source direction.

3. The image processing apparatus of claim 1, further comprising:

a network interface to transmit the received sound signals of the sound output from the detected sound source direction, and an image signal, to an external apparatus through a network, and to receive a sound signal and an image signal from the external apparatus through the network.

4. An image processing method, comprising:

receiving sound signals that are respectively output by a plurality of microphones, the sound signals representing a sound arriving at the plurality of the microphones;

detecting a sound signal in the received sound signals from each one of the plurality of the microphones;

detecting a sound source direction of a source of the received sound signals, based on time difference data, the time difference data indicating a difference in time at which the sound is received from one of the plurality of the microphones with respect to a time at which the sound is received from the outer one of the plurality of the microphones;

calculating a sound level of the received sound signals of the sound output from the detected sound source direction;

detecting, from among users, a speaker who is generating the sound based on position information of the speaker and the detected sound source direction; and displaying a sound level image indicating the calculated sound level in a vicinity of an image of the speaker in a captured image including the images of the users by using the detected sound source direction and the calculated sound level, wherein a position of the sound level image with respect to the image of the speaker in the captured image is determined based on:

a x coordinate value of a left corner of the image of the speaker in the captured image;

x and y coordinate values of an upper corner of the image of the speaker in the captured image;

a size of the sound level image to be displayed in the captured image when the calculated sound level reaches a maximum sound level, and a distance between the image of the speaker and the sound level image to be displayed in the captured image.

* * * * *